United States Patent [19]

Lyman

[11] 4,079,532

[45] Mar. 21, 1978

[54] PHOTOGRAPH DISPLAY STAND

[75] Inventor: George F. Lyman, Weston, Mass.

[73] Assignee: Data Packaging Corporation, Cambridge, Mass.

[21] Appl. No.: 707,372

[22] Filed: Jul. 21, 1976

[51] Int. Cl.[2] ..... G09F 11/14

[52] U.S. Cl. ..... 40/500; 40/497; 40/526

[58] Field of Search ..... 40/73.4, 72, 73, 74, 40/75, 96, 35, 97, 96.5, 98, 102, 104 R

[56] References Cited

U.S. PATENT DOCUMENTS

| | | | |
|---|---|---|---|
| 125,109 | 3/1872 | Wood | 40/73.4 |
| 421,266 | 2/1890 | Glover | 40/73.4 |
| 623,636 | 4/1899 | Stefany | 40/104 R |
| 1,365,107 | 1/1921 | Kehres | 40/73.4 |
| 3,619,922 | 11/1971 | Morgan et al. | 40/97 |
| 3,625,368 | 12/1971 | Toms | 40/102 X |

FOREIGN PATENT DOCUMENTS

| | | | |
|---|---|---|---|
| 28,939 | 5/1910 | Sweden | 40/74 |
| 16,896 of | 1914 | United Kingdom | 40/74 |

*Primary Examiner*—John F. Pitrelli
*Attorney, Agent, or Firm*—Wolf, Greenfield & Sacks

[57] ABSTRACT

A picture display device includes an array of picture frames hinged together, as by an endless belt, in which the inner ends of the frame sections are attached to the endless belt. The frames radiate outwardly from the belt and are arrangeable in a pair of side-by-side packs in which the frames in each pack lie flat against each other, and in which the inner frame sections of one pack abut the inner frame sections of the other pack. A support is provided to hold the packs in side-by-side relation in a manner which permits advancement of and guides the frames from one pack to the next. The frames and the support are arranged so that advancement of a frame from the end of one pack to the beginning of the next pack causes all of the other frames in the array to advance an incremental amount. Means also are provided for biasing each of the frames in each pack flat against each other as well as to bias one of the packs against the other of the packs.

8 Claims, 6 Drawing Figures

PHOTOGRAPH DISPLAY STAND

BACKGROUND AND SUMMARY OF THE INVENTION

This invention relates to a display device for presenting selected of a plurality of pictures or similar articles in sequence. A variety of picture framing and display devices have been proposed and employed in the prior art. Among the more recent which has met with some success has been the "picture cube" having at least five faces made from a transparent material, such as plastic, and with means for mounting a picture against the interior surface of each of the cube faces so that the pictures may be displayed through the transparent faces. Among the limitations of such picture cubes is that they can hold only a limited number of pictures, usually five and in some instances six, in readiness for display. Thus, while the cube itself defines a substantial volume, the great proportion of the interior volume of the cube is not used and is unusable to store additional pictures in readiness for display. Also among the difficulties with the prior cube-type devices is that only one of the pictures can be viewed fully at the one time. While it is possible to view two or three of the sides of the cube at one time, the view is not a full, direct view.

In accordance with the present invention, a substantially greater number of pictures can be retained in readiness for selective display than can be achieved with a conventional picture cube of approximately similar volume and size. In addition, the present invention also enables two pictures to be viewed fully at the same time.

My U.S. Pat. No. 4,033,058, issued July 5, 1977 discloses a picture and display device including a plurality of picture frames having inner frame sections which are connected endlessly to define a belt-like configuration and in which the frames radiate outwardly from the belt. The endlessly connected frames are mounted on a support which enables the belt-like configuration to be advanced endlessly in one-frame increments. The device is mounted to define a plurality of runs and operates in a manner which, when one of the frames is advanced from one run to the next run, all of the frames advance one incremental step.

The present invention relates to an improvement to the devices described in my foregoing applications. In the present invention, the frames are mounted so that they advance endlessly about a generally heightwise extending axis and in which all of the pictures on display are displayed right side up, both from a front and a rear view. The present invention also employs a means for biasing the individual frames in each pack flush against each other as well as to bias the packs themselves against each other.

It is among the general objects of the invention to provide a picture displaying device which contains a greater number of pictures in readiness for selective display than has been obtainable with prior devices of comparable volume and size.

Another object of the invention is to provide a device of the type described in which two pictures may be viewed fully and simultaneously, in an upright position, and from either the front or the back of the device.

A further object of the invention is to provide a device of the type described in which there are two packs of picture frames supported in side-by-side relation and in which the picture frames are advanceable in one-frame increments about a generally heightwise extending axis.

Another object of the invention is to provide a display device of the type described in which the frames in each pack are biased firmly against each other and in which the packs themselves are biased firmly against each other.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENT

Figure 1:
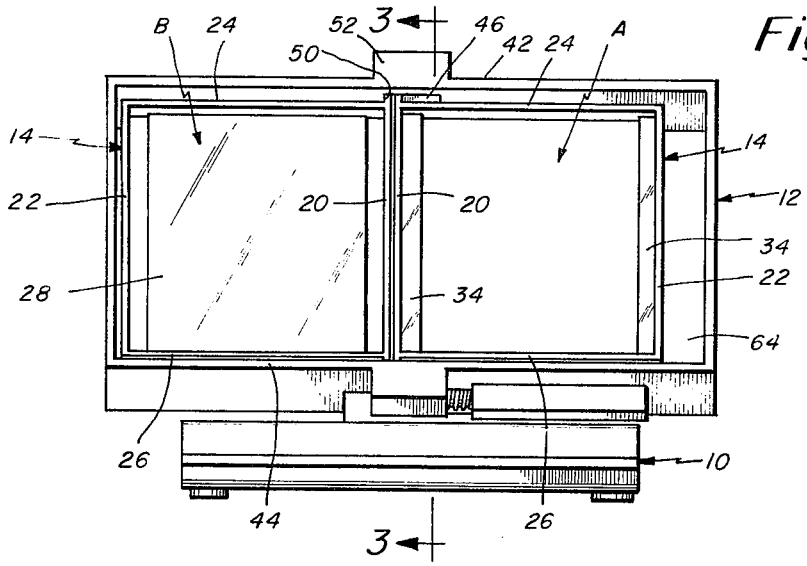
FIG. 1 is a front elevation of the device.
Figure 3:
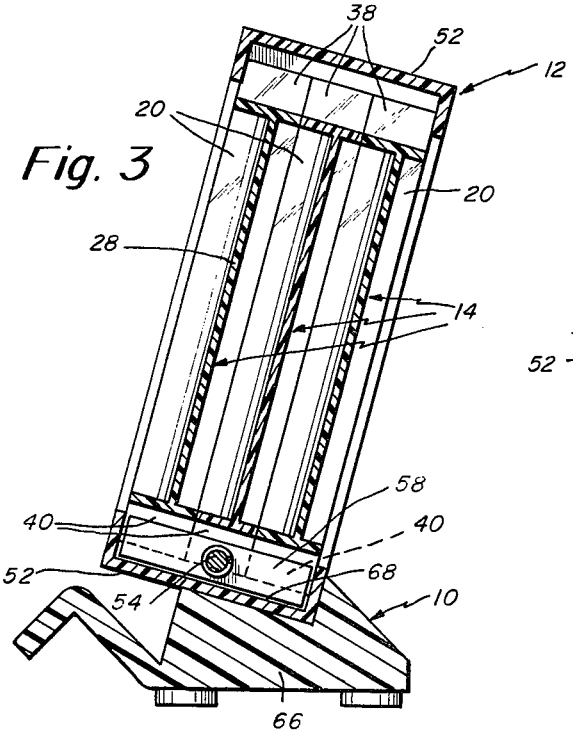
FIG. 3 is a side elevation, in section, of the device as seen along the line 3—3 of FIG. 1.
Figure 2:
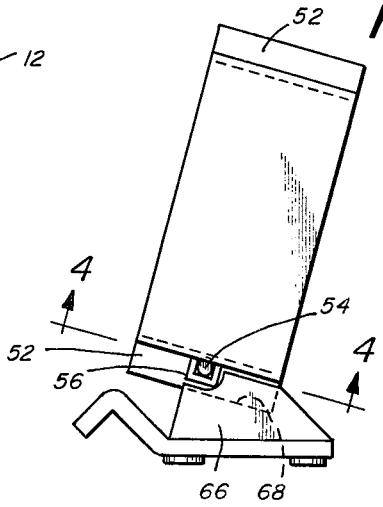
FIG. 2 is a side elevation of the device.
Figure 4:
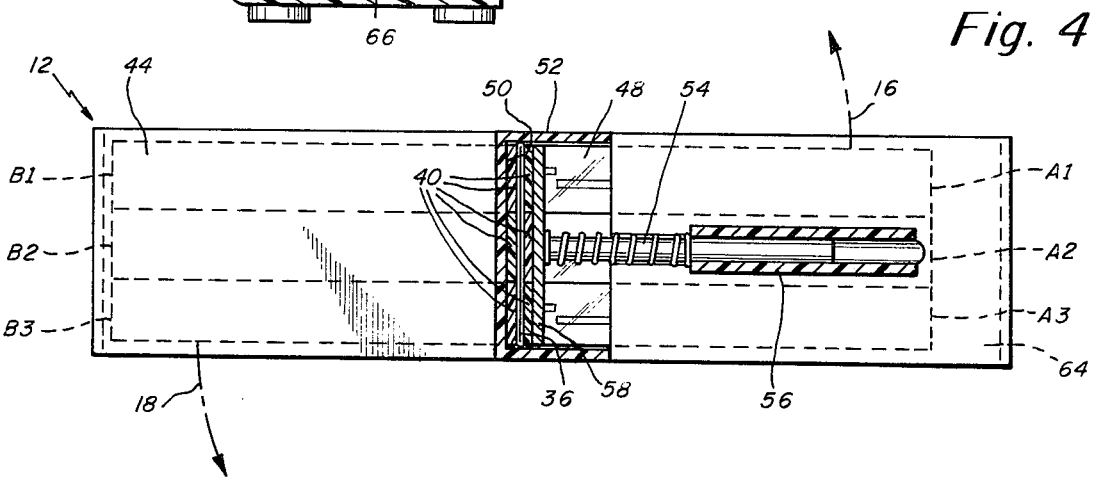
FIG. 4 is a sectional illustration of the device as seen along the line 4—4 of FIG. 2.

As shown in FIGS. 1–3, the illustrative embodiment of the invention includes a base 10 which supports a rectangular main frame 12. The main frame 12 surrounds and provides support for a plurality of picture frames 14. The picture frames 14 are arranged in two packs, indicated at A and B, respectively, which are disposed in side-by-side relation within the main frame 12. As shown in FIG. 3, the picture frames 14 in each pack abut each other in face-to-face relation. The picture frames 14 are connected together, at their inner frame sections, in an endlessly hinged arrangement which enables the array of picture frames to be advanced in one-frame increments to enable sequential presentation of the pictures held in the picture frames 14. For example, FIG. 4 shows, in phantom, the various positions of the picture frames in which A1 represents the position of a picture frame at the front facing end of the pack A, A2 represents the position of a picture frame in the middle of the pack A and A3 represents the position of a picture frame at the rearwardly facing, beginning of the pack A. Similarly, the pack B may be considered as having (in the embodiment illustrated) three picture frame positions identified as B1, B2 and B3. The picture frames 14 and main frame 12 are arranged so that a picture frame 14 at the A1 position may be pivoted to the B1 position while the picture frame at the B3 position pivots to the A3 position as suggested by the arrow 18 in FIG. 4. The other picture frames 14 advance one incremental position, for example, the frame which was at position A2 then moves to the A1 position while the frame at position A3 moves to the A2 position, the frames in the pack B having like incremental advancement. The direction of advancement may be reversed, in which the picture frame 14 in the A3 position is rotated in a rearward direction toward the B3 position and in which the other picture frames advance accordingly. Each of the picture frames 14 is arranged to retain and display a photograph or other similar flat member from each of its faces. Thus, when viewed from the front two pictures will be displayed fully and in an upright position. Similarly, when viewed from the rear, two pictures will be displayed, side by side, in a full and upright position.

Each of the picture frames 14 includes an inner frame section 20, an outer frame section 22, a top frame section 24 and a bottom frame section 26. Each of the frame sections 20–26 is of the same depth. In the embodiment shown, the picture frames are of square configuration. Each of the picture frames 14 includes means for removably holding a pair of photographs or the like in back-to-back relation so that the photographs may be exposed at each of the opposite faces of each of the picture frames. In the embodiment shown, the pictures are supported by a transparent panel 28 secured at its upper and lower ends to the top and bottom frame sections 24, 26. The width of the panel 28 is less than the interior width defined by the inner and outer frame sections 20, 22, thus leaving a space 30 between the side edges 32 of the panel 28 and the inner and outer frame sections 20, 22. Each of the picture frames 14 has a flange 34 associated with each of the spaces 30. The flanges 34 in each frame extend along the length of their associated inner and outer frame sections 20, 22 and project inwardly to overlap the spaces 30. The flanges 34 are offset slightly from the general plane of their associated panel 28 to permit the edges of the photograph or the like to be inserted into the small gaps between the panel 28 and the flanges 34. A pair of photographs or the like may be arranged back-to-back and the opposite edges of the combined photographs can be inserted into each of the picture frames 14. The panel 28 and flanges 34 serve a dual function, to retain the photographs in place as well as to provide additional strength and rigidity for each of the picture frames 14. The foregoing frame structure also serves to protect the photographs by maintaining them well recessed within the center of the frame so that each of the frame sections defines a substantial and deep margin about its enclosed pictures. In addition, those of the frames which lie close against each other in a stack-like configuration abut each other to enclose their respective photographs.

The picture frames 14 are sequentially hinged to each other at their inner frame sections 20, for example, by an endless belt-like, flexible tape strip 36, and can be provided apart up to about 180°. The width of the tape strip preferably is the same as the height of the inner frame sections 20 so that it may adhere fully along and to the outer surface of each of the inner frame sections. The foregoing arrangement for hinging the frame sections together enables them to be arranged in the side-by-side packs A and B and in a manner in which the inner frame sections 20 of the picture frames 14 in pack A abut and lie flat against the corresponding inner frame sections 20 of the picture frames 14 in the pack B (see FIG. 4). When the picture frames 14 are in their display position shown in FIGS. 1–4, the flat inner frame sections 20 in each pack A, B are aligned and extend generally along a plane.

The array of picture frames 14 is supported and guided for the incremental advancement described above by means of upper and lower projections 38, 40, respectively, which extend from each of the inner frame sections 20 and define continuations of the inner frame sections 20. The top and bottom portions 42, 44 of the main frame 12 are provided with openings 46, 48, respectively, which receive the upper and lower projections 38, 40. The openings 46, 48 preferably are rectangular and are defined at least in part by a straight edge 50 which extends in a forward-rearward direction and against which all of the aligned lower projections 40 can abut. If desired, a cap 52 can be attached to each of the top and bottom portions 42, 44 to cover the openings 46, 48 and define a well which receives and encloses the upper and lower projections 38, 40. The openings 46, 48 should be at least as wide as the depth of an individual of the picture frames 14 to enable the projections 38, 40 to move and advance within the openings 46, 48 as described below.

Means are provided for biasing the picture frames 14 in each of the packs A, B flat against each other (FIGS. 3 and 4) and also to bias the packs firmly against each other in which the inner frame sections 20 of one pack are urged firmly against the aligned inner frame sections of the other pack. In the illustrative embodiment, this is accomplished by a spring-biased plunger 54 which is mounted to the underside of the bottom portion 44 of the main frame 12 and which is guided for transverse axial movement by a hollow guide 56 attached to the underside of the bottom portion 44 of the main frame 12. The plunger 54 has a pressure plate 58 attached to its protruding end and a compression spring 60 is disposed about the plunger 54 and extends between the end of the guide 56 and the pressure plate 58 to bias the pressure plate 58 firmly into engagement with the lower projections 40 associated with one of the packs (shown in FIG. 4 as engaging the projections 40 of pack A). The pressure plate 58 is sufficiently long to fully engage the surfaces of the lower projections 40 to press the lower projections 40 flat against each other and against the edge 50 of the lower opening 48. If, as shown in the illustrative embodiment, the lower opening 48 has a covering cap 52, a side portion of the cap 52 may be omitted or cut away to permit the plunger 54 to pass through the cap into the well which it defines. This assures that the inner frame sections in each pack will remain in their flat alignment and that the inner frame sections 20 in each of the packs will lie flat against the corresponding inner frame sections in the other pack. As a result, the packs are maintained together and the picture frames in each of the packs lie in flush abutting face-to-face position within the main frame 12 as suggested in phantom in FIG. 4.

Figure 5:
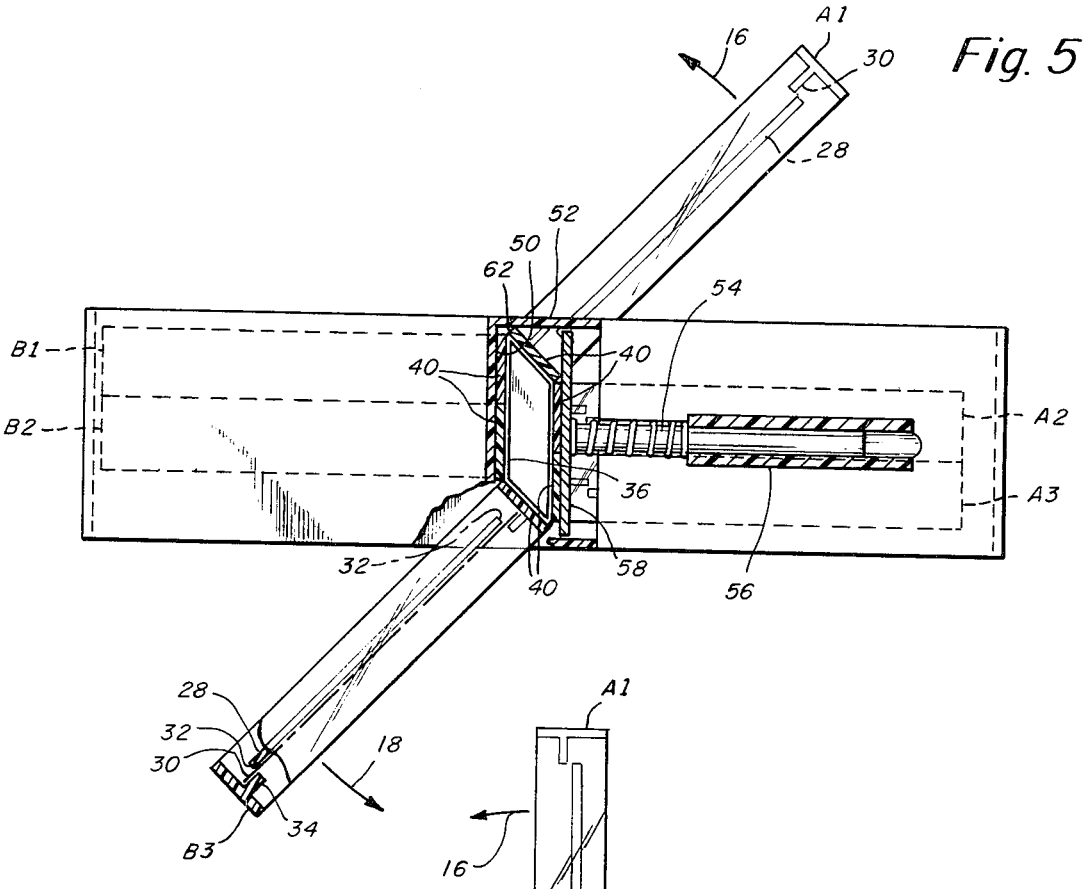
FIG. 5 is an illustration similar to FIG. 4 showing the manner in which the device operates to advance each of the frames one frame increment in response to advancement of one of the frames from the end of one of the packs to the beginning of the other of the packs.

FIGS. 4 and 5 illustrate the operation of the device and the manner in which the frames are advanced simultaneously in increments. When it is desired to advance the frames to display a new series of pictures, one of the exposed frames, for example, the frame in the position A1 in FIG. 4, is grasped and pivoted forwardly as suggested by the arrow 16 in FIG. 4. As shown in FIG. 5, the forwardmost edge 62 of each of the upper and lower projections 38, 40 of the pivoting picture frame 14 will serve as a fulcrum about which that frame can pivot. This pivoting action draws the trailing picture frames 14 in that pack (the frames which were in the positions A2, A3) forwardly toward their next successive positions A1, A2. That, in turn, draws the picture frame 14 which was in the A3 position to pivot that frame in the direction suggested by the arrow 18, toward the beginning of the other pack A to the A3 position. The inner frame sections 20 and connecting tape or belt 36 thus assume a generally parallelogram configuration which progressively approaches a rectangular configuration at which time each of the pivoting and pivoted picture frames 14 have each rotated through approximately 90°. When the inner frame sections 20 (and their associated projections 38, 40) having pivoted to the 90° position, continued rotation of the pivoting frame causes the parallelogram to collapse and completes the advancement of each of the picture frames by one-frame increment.

The spring biased pressure plate 58 bears flush against the lower projections 40 of the non-pivoting picture frame at all times, those projections 40 sliding along the surface of the plate 58 as the picture frames advance. The spring biased plate 58 provides a restorative force which continually tends to maintain the frames 14 in their display position. For example, if the pivoting frame shown in FIG. 5 was released before it had been rotated to approximately 90°, the force of the pressure plate 58 which continually tends to collapse the parallelogram, would cause the frames to spring back to their original positions. When the frame is rotated through and beyond 90°, the spring force similarly tends to collapse the parallelogram. The pivoting frame can then be simply released and all of the frames will then be urged to their advanced incremental position. Because the openings 46, 48 are just wide enough to accomodate the combined depth of the inner frame sections when the sections are in flat alignment as shown in FIG. 4, the packs are self-centering in the main frame.

In the embodiment shown, the picture frames 14 are supported by the lower ends of the lower projections 40 which rest, slidably, on the bottom cap 52. The length of the lower projections 40 and the depth of the cap are selected so that when the array of picture frames 14 is disposed in the main frame, the bottom frame sections 26 will be just slightly spaced above the bottom portion 40 of the main frame 12. The picture frames 14 thus are supported by the lower ends of the lower projection 40. The picture frames 14 and main frame 12 also are dimensioned so that there will be a slight clearance between the top frame sections of the picture frames and the upper portion of the main frame 12. In the event that caps 52 are not employed or if it be otherwise desired, the array of frames 14 may be supported directly by the bottom frame sections 26 with the lower projections 40 being dimensioned to permit the bottom frame sections 26 to rest directly on and slide on the bottom portion of the main frame 12.

It also should be noted that the internal width of the main frame 12 is slightly more than the combined width of the abutted picture frame packs A, B so that when the packs A, B are in their display position, biased together by the spring pressure plate 58, there will be a space 64 (FIG. 1) between one of the packs and its adjacent side portion of the main frame 12. The space 64 is intended to facilitate access to the frame to be pivoted, either from the front or rear side of the device. Also, it provides a clearance for the pack A which shifts to the right (FIG. 5) as a frame is pivoted from the end of one pack to the beginning of the other pack.

The main frame 12 may be mounted on the base 10 in any number of ways. In the embodiment shown, the base 10 has a central upstanding portion 66 which is formed to include a downwardly and rearwardly inclined socket 68 shaped to receive the lower cap 52. The attitude of the socket 68 supports the main frame 12 in the slightly rearwardly inclined attitude shown. Although in the embodiment illustrated, the main frame is not perfectly vertical, the inner frame sections 40 may be considered as being advanceable about a generally vertical axis. By arranging the picture frames to be advanceable about a generally vertical axis, all of the pictures are supported and displayed at all times in an upright position when viewed from the front as well as from the rear of the device.

Figure 6:
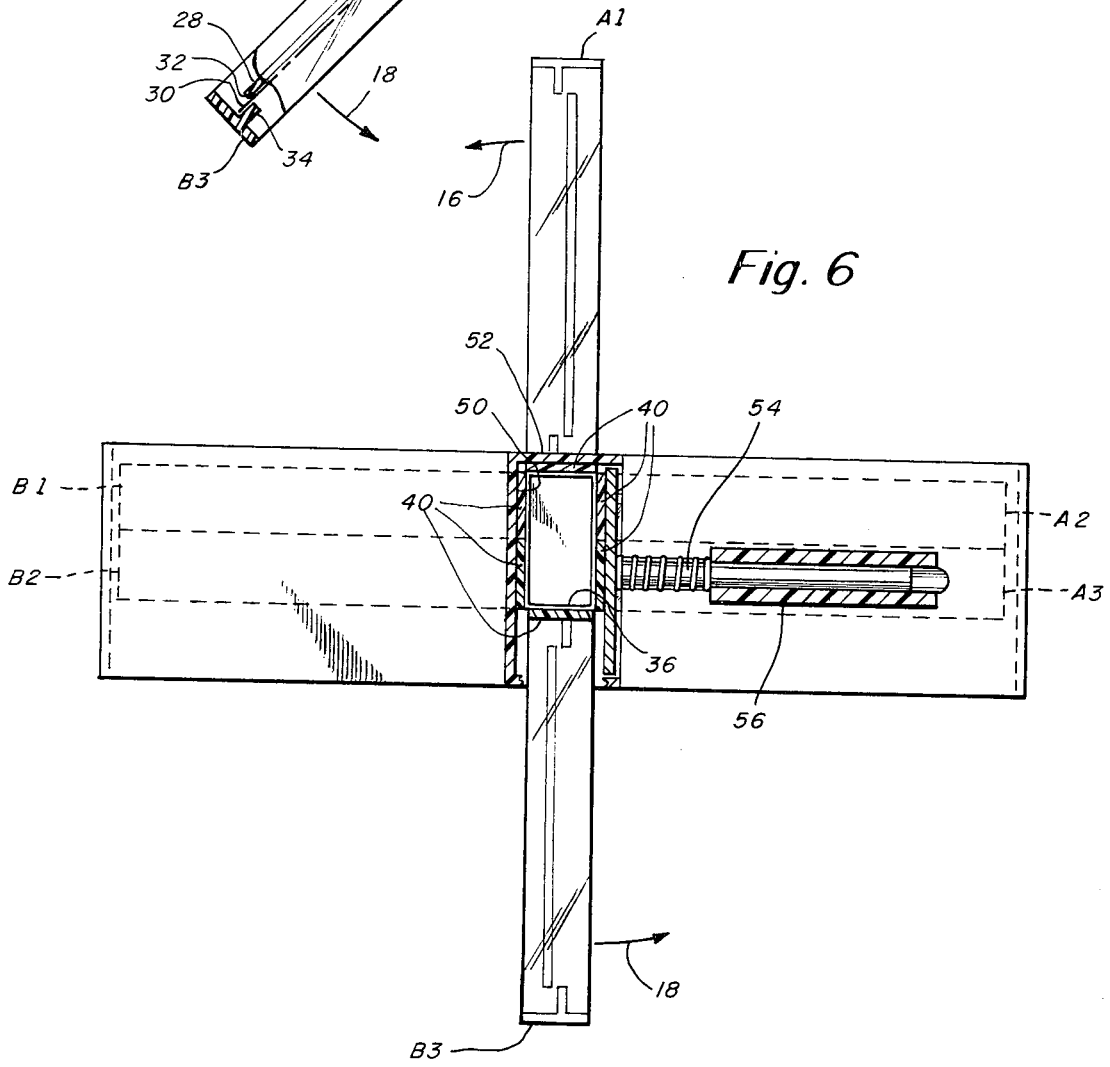
FIG. 6 is a diagrammatic illustration of the frames in an intermediate position.

It should be noted that the device also is capable of being operated to provide an intermediate display position as suggested somewhat diagrammatically in FIG. 6. In this intermediate display position, the pivoted and pivoting picture frames are stopped at their 90° position in which the inner frame sections 20 define the rectangular configuration. When in the rectangular configuration, the pressure of the plate 58 tends to hold the frames in this configuration because of the relative stability of the rectangular arrangement as compared to the unstable parallelogram configuration.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A display device for pictures or the like comprising:

a plurality of picture frames, each of the picture frames having means for removably retaining a pair of pictures and for displaying the retained pictures at opposite faces of the frame;

hinge means connecting one side of each frame to the corresponding side of each adjacent frame, the hinged frame sides being arranged in an endlessly connected configuration;

said hinge means and said picture frames being constructed and arranged to enable a pair of adjacent frames to be pivoted apart not substantially beyond 180°;

said picture frames being arrangeable in a plurality of consecutive packs in which the frames in each pack lie in face-to-face, serial relation with each other;

means for supporting the assembly of picture frames to enable the advancement thereof in increments in which each increment advances one of the frames from the end of one of the packs to the beginning of the next consecutive pack, said supporting means and picture frames being constructed and arranged so that all of the frames in each of the packs are advanced one increment in response to advancement of any one of the frames from the end of one pack to the beginning of the next consecutive pack; and means for resiliently biasing the picture frames in each pack against each other.

2. A display device as defined in claim 1 further comprising:

said picture frames being arranged in a pair of said packs; and said biasing means being constructed and arranged to bias the connected sides of the picture frames in one pack toward and against the connected sides of the picture frames in the other of the packs.

3. A display device for pictures or the like comprising:

a plurality of picture frames, each of the picture frames having means for removably retaining a pair of pictures and for displaying the retained pictures at opposite faces of the frame;

hinge means connecting one side of each frame to the corresponding side of each adjacent frame, the hinged frame sides being arranged in an endlessly connected configuration;

said hinge means and said picture frames being constructed and arranged to enable a pair of adjacent frames to be pivoted apart not substantially beyond 180°;

said picture frames being arrangeable in a plurality of consecutive packs in which the frames in each pack lie in face-to-face, serial relation with each other;

each of the picture frames having a projection extending from an end of its connected side, said projection extending through an opening formed in the means for supporting the assembly of picture frames;

means for supporting the assembly of picture frames to enable the advancement thereof in increments in which each increment advances one of the frames from the end of one of the packs to the beginning of the next consecutive pack, said supporting means and picture frames being constructed and arranged so that all of the frames in each of the packs are advanced one increment in response to advancement of any one of the frames from the end of one pack to the beginning of the next consecutive pack;

means for biasing the picture frames in each pack against each other;

said means for biasing the picture frames comprising a pressure member carried by the supporting means and movable toward and away from the projections and means for resiliently urging the pressure member toward the projections;

said pressure member being constructed and arranged to engage the projections associated with the picture frames in one of the packs to urge those projections into an aligned configuration and into engagement with the projections associated with the picture frames in the other of the packs thereby to resiliently grip the projections between the pressure member and an edge of the opening in the supporting means.

4. A display device as defined in claim 3 further comprising:

said projections being of substantially flat configuration and defining extensions of the connected sides of the picture frames, said projections and biasing means being constructed so that when said picture frames are in a display position, the projections associated with each of the packs are generally aligned along planes which parallel each other.

5. A display device as defined in claim 3 wherein the means for supporting the assembly of picture frames comprises:

means defining an opening having at least some of its edges arranged in a rectangular configuration and including a side edge, a front edge and a rear edge;

the projections extending downwardly from their associated picture frames through the opening;

a bottom, projection-supporting member disposed below the opening in the main frame at a location to receive and support the lower ends of the projections and to enable the lower ends of the projections to slide on the bottom supporting member; and said means for biasing the picture frames comprising a pressure member mounted for movement toward and away from the downwardly extending projections and being constructed and arranged to urge the downwardly extending projections toward said side edge defined by said opening.

6. A display device as defined in claim 5 wherein the means for supporting the assembly of picture frames further comprises:

a rectangular main frame having a top portion, a bottom portion and a pair of connective side portions, each of the top and bottom portions having a generally rectangular opening formed therein;

said projections extending from each of the opposite ends of the connected sides of each of the picture frames, the upwardly extending projections being received in the opening in the upper portion of the main frame and the downwardly extending projections being received in the opening formed in the lower portion of the main frame.

7. A display device as defined in claim 6 further comprising:

the side portions of the main frame being spaced apart a distance greater than the combined width of the picture frames of the two packs thereof supported by the main frame;

said biasing means being constructed and arranged to urge said assembly of packs away from one of the side portions of the main frame to define a space between said side portion and the outer ends of the picture frames in the pack adjacent said side portion thereby to provide access to the outer frame sections of the picture frames in that pack.

8. A display device as defined in claim 6 further comprising:

a cap attached to and extending downwardly from the bottom portion of the main frame; and a base member for supporting the main frame, said base member having a socket formed therein to receive the cap in a frame-supporting attitude.

* * * * *